US010472920B2

(12) United States Patent
Farquhar et al.

(10) Patent No.: US 10,472,920 B2
(45) Date of Patent: Nov. 12, 2019

(54) PACKING ELEMENT WITH TIMED SETTING SEQUENCE

(71) Applicant: Halliburton Energy Services, Inc., Houston, TX (US)

(72) Inventors: Graham Farquhar, Turriff (GB); Max Ogilvie, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 108 days.

(21) Appl. No.: 15/531,689

(22) PCT Filed: Jun. 24, 2016

(86) PCT No.: PCT/US2016/039329

§ 371 (c)(1),
(2) Date: May 30, 2017

(87) PCT Pub. No.: WO2017/222561

PCT Pub. Date: Dec. 28, 2017

(65) Prior Publication Data

US 2018/0209241 A1 Jul. 26, 2018

(51) Int. Cl.
*E21B 33/12* (2006.01)
*E21B 33/128* (2006.01)
(Continued)

(52) U.S. Cl.
CPC ..... *E21B 33/128* (2013.01); *E21B 23/06* (2013.01); *E21B 33/12* (2013.01); *E21B 33/1208* (2013.01);
(Continued)

(58) Field of Classification Search
CPC .. E21B 33/12; E21B 33/1216; E21B 33/1208; E21B 33/128; E21B 2033/005
See application file for complete search history.

(56) References Cited

U.S. PATENT DOCUMENTS 3,036,639 A * 5/1962 Baker ..... E21B 33/1216 166/134
4,509,763 A * 4/1985 Fischer ..... E21B 33/1208 277/342

(Continued)

OTHER PUBLICATIONS

International Search Report and Written Opinion dated Mar. 20, 2017; International PCT Application No. PCT/US2016/039329.

*Primary Examiner* — Yong-Suk Ro
(74) *Attorney, Agent, or Firm* — McGuireWoods LLP

(57) ABSTRACT

A packing element and a sealing element is disclosed. The packing element includes a sealing element positioned on an outer surface of a mandrel deployed in the wellbore, where the sealing element is disposed in an annulus between the mandrel and a portion of the wellbore. The sealing element includes a first cavity on an inner surface of the sealing element, where the first cavity has a first size and is positioned proximate a first end of the sealing element. The sealing element also includes a second cavity on the inner surface of the sealing element, where the second cavity has a second size that is different from the first size, and is positioned proximate a second end of the sealing element. The packing element also includes a first and second gauge rings positioned at first and second ends of the sealing element, respectively.

11 Claims, 9 Drawing Sheets

(51) Int. Cl.
*E21B 23/06* (2006.01)
*E21B 33/00* (2006.01)

(52) U.S. Cl.
CPC ..... *E21B 33/1216* (2013.01); *E21B 2033/005* (2013.01)

(56) References Cited

U.S. PATENT DOCUMENTS

| | | | | |
|---|---|---|---|---|
| 5,165,703 | A * | 11/1992 | Morvant | E21B 33/1208 277/342 |
| 5,511,620 | A * | 4/1996 | Baugh et al. | E21B 33/12 166/387 |
| 5,641,019 | A * | 6/1997 | Stout et al. | E21B 33/1208 166/179 |
| 5,775,429 | A | 7/1998 | Arizmendi et al. | |
| 8,397,803 | B2 | 3/2013 | Crabb et al. | |
| 8,602,116 | B2 | 12/2013 | Crabb | |
| 2006/0243457 | A1* | 11/2006 | Kossa | E21B 33/1208 166/387 |
| 2007/0044977 | A1 | 3/2007 | Hendrickson et al. | |
| 2011/0037299 | A1 | 2/2011 | Clarke | |
| 2012/0133098 | A1* | 5/2012 | Farquhar | E21B 33/128 277/314 |
| 2015/0129242 | A1 | 5/2015 | Farquhar | |

* cited by examiner

PACKING ELEMENT WITH TIMED SETTING SEQUENCE

BACKGROUND

The present disclosure relates to oil and gas exploration and production, and more particularly, to a packing element with a setting sequence that is used in a wellbore.

Wells are drilled at various depths to access and produce oil, gas, minerals, and other naturally-occurring deposits from subterranean geological formations. In the course of drilling and using a subterranean wellbore for hydrocarbon production, one or more packers, which may also be called packing elements, may be installed in the wellbore.

Packers are used in wells to seal off annular spaces between tubular strings (such as tubing and casing or liner strings, etc.) or between a tubular string and a wellbore surface. Another use for some packers is to support tubing and other equipment while also providing the seal in a well annulus between, for example, the tubular string and the wellbore surface. In wells with multiple reservoir zones, packers may be used to isolate perforations for each zone. Packers may also be used to protect the casing from pressure and produced fluids, isolate sections of corroded casing, casing leaks, or squeezed perforations, and isolate or temporarily abandon producing zones.

Based on their primary use, packers may be divided into two main categories: production packers and service packers. Production packers are those that remain in the well during well production. Service packers are used temporarily during well service activities such as cement squeezing, acidizing, fracturing, and well testing. Packers may also be classified according to whether they are permanent or retrievable. A permanent packer is removed using milling in order to break and remove the permanent packer from within the wellbore. The main advantages of permanent packers are potentially lower cost and greater sealing and gripping capabilities. A retrievable packer may be unset and removed by, for example, either shearing a metal ring or shifting a sleeve to disengage connecting components of the retrievable packer.

Retrievable packers may have a complicated design and generally lower sealing and gripping capabilities, but after removal and subsequent servicing, they may be reused.

Packers are set by providing a compressive force across the packer. For example, certain packers are set hydraulically, other packers are set using a differential fluid pressure across the packer, and still other packers are set mechanically. One limiting factor associated with packers is sealability or pressure integrity of the packer which can be affected by how the packer is set initially as well as other variables including, but not limited to, a packer shape and material.

BRIEF DESCRIPTION OF THE DRAWINGS

Illustrative embodiments of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different embodiments may be implemented.

DETAILED DESCRIPTION

The present disclosure relates generally to a packing element with a sealing element that includes cavities of different sizes. The packing element does not include any vent holes that may cause potential leaks during hydrocarbon production. Further, the packing element has an inner diameter that forms an interference fit with an outer surface of the mandrel to reduce pressure in the wellbore (swabbing). Further, the packing element provides symmetrical setting of the sealing element in a wellbore. The packing element may be run into a wellbore with a smaller initial outer diameter that then expands externally to create a seal between an outer surface of tubular string such as a mandrel, casing, or production tubing and a wellbore surface. More particularly, the packing element utilizes a sealing element that is manufactured from flexible and expandable materials, such as single and dual elastomeric materials, non-elastomeric composites, metallic materials, metallic matrix materials, and similar materials. The outer diameter of the packing element may be expanded by squeezing the elastomeric sealing element between two plates or gauge rings, forcing the sealing element to bulge outward.

The packing element may be set in cased holes and may be run on wireline, pipe, or coiled tubing. For example, the packing element may be run in a wellbore on production tubing or wireline along with other tools and/or instruments. The wellbore may be provided with or without a casing on a wellbore surface. Once the desired depth is reached, the packing element may then be expanded out to contact the wellbore surface. In some embodiments, a compressive force is applied to expand the packing element. In one of such embodiments, axial loads may be applied to push a sealing element of the packing element up a wedge ramp of a wedge ring to compress the sealing element, thereby causing the sealing element to expand outward. In some embodiments, a sealing element of the packing element is activated by applying pressure from a surface to a wellbore fluid. The packing element may also be actuated in other methods, including without limitation by hydrostatic pressure, use of a hydraulic setting tool and pressure applied from the surface, dropping a ball in the hydraulic setting tool, electrically, downhole hydraulic pressure generation triggered by a signal from the surface, or any combination of these or similar methods. In other embodiments, the packing element may be remotely activated upon receiving a pressure or acoustical signal.

Figure 1:
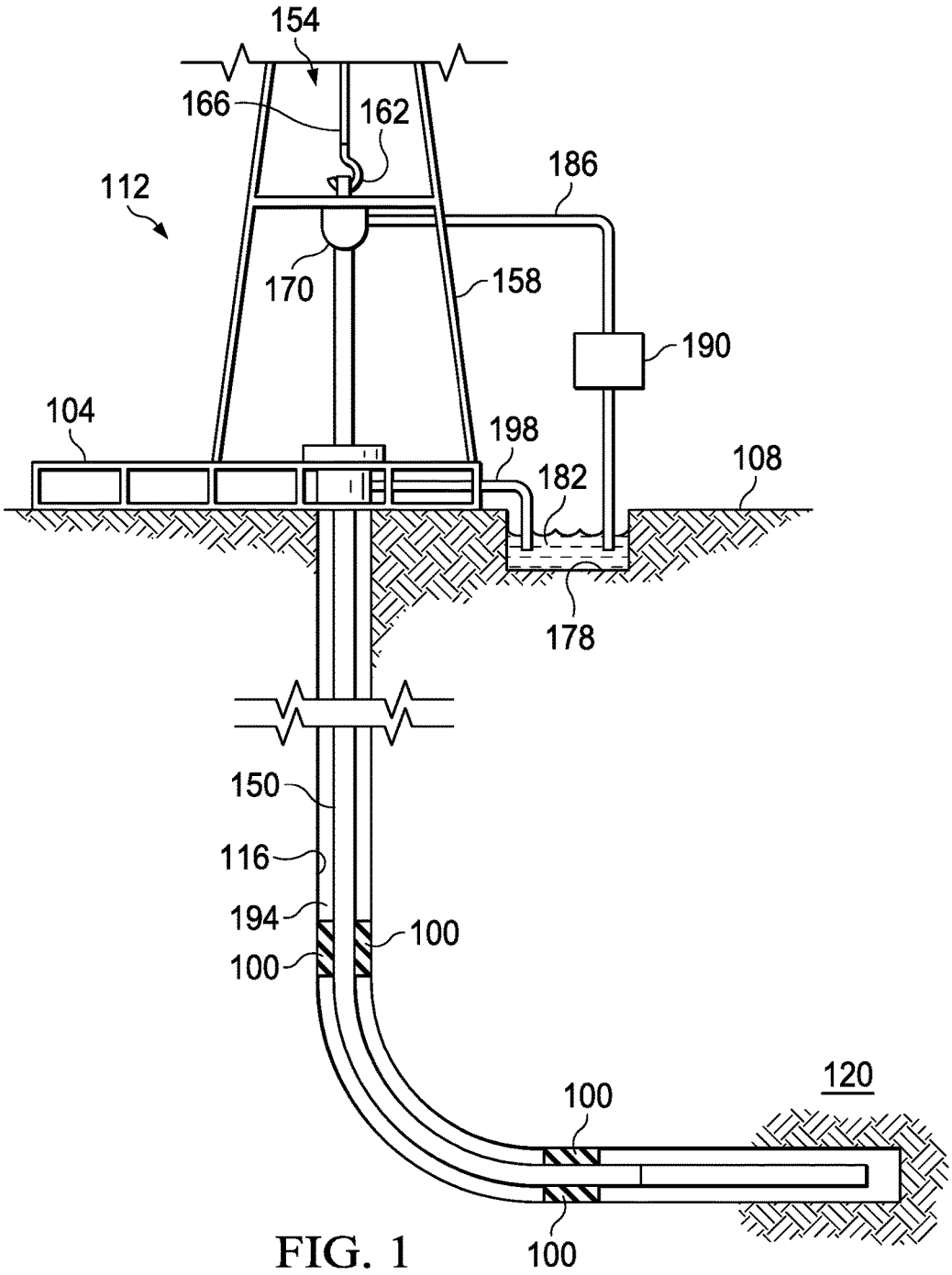
FIG. 1 illustrates a schematic view of an on-shore well drilling environment having a packing element according to an illustrative embodiment.

FIG. 1 illustrates a schematic view of a rig 104 operating one or more packing elements 100 in an annulus 194 according to an illustrative embodiment. Rig 104 is positioned at a surface 108 of a well 112. The well 112 includes a wellbore 116 that extends from the surface 108 of the well 112 to a subterranean substrate or formation 120. The well 112 and rig 104 are illustrated onshore in FIG. 1. FIG. 1 illustrates possible uses or deployments of a packing element 100, and while the following description of the packing element 100 primarily focuses on the use of the packing element 100 during the drilling, completion, and production stages, the packing element 100 also may be used in other stages of the well where it may be desired to set barrier sealing devices such as bridge plugs, or packers, or to create or maintain multiples zones within the wellbore using one of the foregoing devices and to prevent leaks during hydrocarbon production.

In the embodiment illustrated in FIG. 1, the wellbore 116 is formed by a drilling process in which dirt, rock, and other subterranean material is removed to create the wellbore 116. During or after the drilling process, a portion of the wellbore may be cased with a casing (not illustrated). In other embodiments, the wellbore 116 may be maintained in an open-hole configuration without casing. The embodiments described herein are applicable to either cased or open-hole configurations of the wellbore 116, or a combination of cased and open-hole configurations in a particular wellbore.

After drilling of the wellbore is complete and the associated drill bit and drill string are "tripped" from the wellbore 116, a work string 150 which may eventually function as a production string is lowered into the wellbore 116. The work string 150 may include sections of tubing, each of which are joined to adjacent tubing by threaded or other connection types. The work string may refer to the collection of pipes or tubes as a single component, or alternatively to the individual pipes or tubes that comprise the string. The term work string is not meant to be limiting in nature and may refer to any component or components that are coupled to the packing element 100 to lower or raise the packing element 100 in the wellbore 116 or to provide a signal, energy, or force to the packing element 100 such as that provided by fluids, electrical power or signals, or mechanical motion. Mechanical motion may involve rotationally or axially manipulating portions of the work string 150. In some embodiments, the work string 150 may include a passage disposed longitudinally in the work string 150 that facilitates fluid communication between the surface 108 of the well 112 and a downhole location.

The lowering of the work string 150 may be accomplished by a lift assembly 154 associated with a derrick 158 positioned on or adjacent to the rig 104 or offshore platform. The lift assembly 154 may include a hook 162, a cable 166, a traveling block (not shown), and a hoist (not shown) that cooperatively work together to lift or lower a swivel 170 that is coupled to an upper end of the work string 150. The work string 150 may be raised or lowered as needed to add additional sections of tubing to the work string 150 to position the packing element 100 at a downhole location in the wellbore 116.

In one embodiment, a reservoir 178 may be positioned at the surface 108 to hold a fluid 182 for delivery to the well 112 during setting of the packing element 100 in the annulus 194.

A supply line 186 is fluidly coupled between the reservoir 178 and the passage of the work string 150. A pump 190 drives the fluid 182 through the supply line 186 and the work string 150 toward the downhole location. As described in more detail below, the fluid 182 may also be used to carry out debris from the wellbore prior to or during the completion process. After traveling downhole, the fluid 182 or portions thereof returns to the surface 108 by way of the work string 150. At the surface 108, the fluid may be returned to the reservoir 178 through a return line 198. The fluid 178 may be filtered or otherwise processed prior to recirculation through the well 112.

Figure 2B:
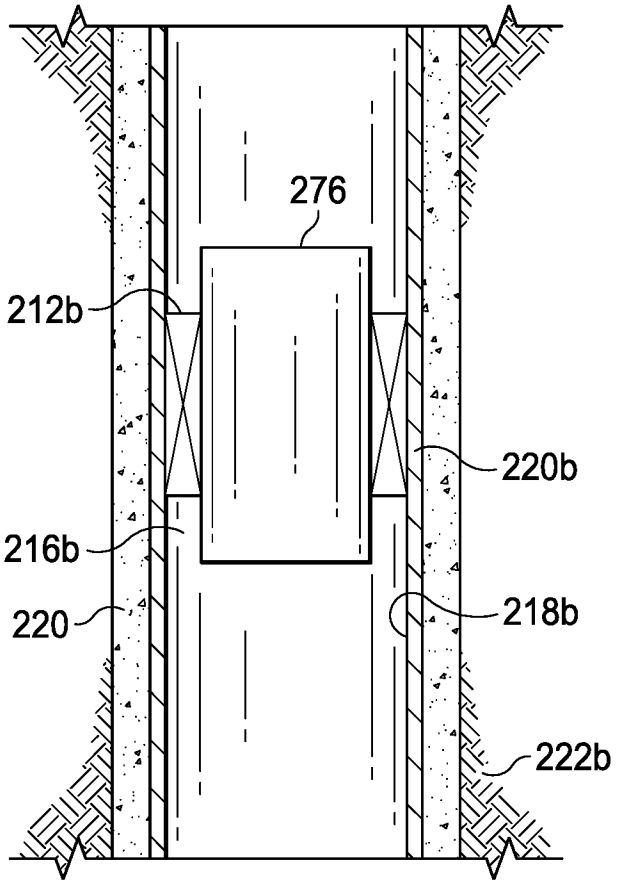
FIG. 2B illustrates a cross-sectional schematic view of a packing element set between a mandrel and a wellbore surface according to an illustrative embodiment.
Figure 2A:
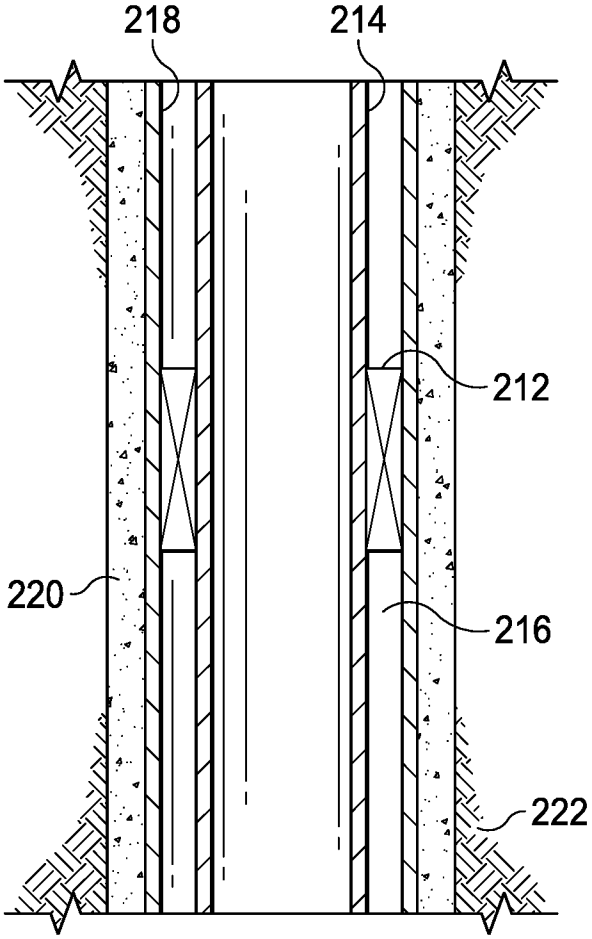
FIG. 2A illustrates a cross-sectional schematic view of a packing element set between a tubular pipe and a wellbore surface according to an illustrative embodiment.

FIGS. 2A and 2B illustrate schematic views of a packing element 212 and 212*b* disposed between a tubular string 214 and a wellbore 222 according to an illustrative embodiment. The packing elements 212 and 212*b* are similar to the packing elements 100 referenced in FIG. 1 and may be supporting, or coupled to, a work string similar to work string 150.

In FIG. 2A, a packing element 212, which may also be called a well packing element, is located along an outer surface of a tubular string 214 positioned in a wellbore 222. The packing element is set as shown in FIG. 2A, so that the packing element seals off an annulus 216 between the tubular string 214 and a wellbore surface 218.

The wellbore surface 218 in FIG. 2A may include an inner surface of a liner or casing 220 cemented in the wellbore 222. In other examples, the wellbore surface 218 may include only a wall of the wellbore 222 without the inner surface of the liner or casing 220 (e.g., if the wellbore is uncased or open hole).

The packing element grips between the tubular string 214 and the wellbore surface 218, so that the tubular string 214 is supported and held in place within the wellbore 222. Although in FIGS. 2A and 2B the wellbore 222, 222*b* is depicted as being generally vertical, in other examples, the wellbore could be generally horizontal or deviated. In another embodiment, as shown in FIG. 2B, the packing element 212*b* may be used to seal off an annulus 216B between a mandrel 276 and a wellbore surface 218*b*. The mandrel 276 may be either a bar, shaft, or spindle around which other components may be arranged or assembled. The mandrel 276 may include specialized tubular components that are parts of an assembly or system, such as gas-lift mandrel or packer mandrel. Similar to FIG. 2A, the wellbore surface 218*b* in FIG. 2B may include an inner surface of a liner or casing 220*b* cemented in the wellbore 222*b*. In other examples, the wellbore surface 218*b* may include only a wall of the wellbore 222*b* without the inner surface of the liner or casing 220*b* (e.g., if the wellbore is uncased or open hole).

Figure 3A:
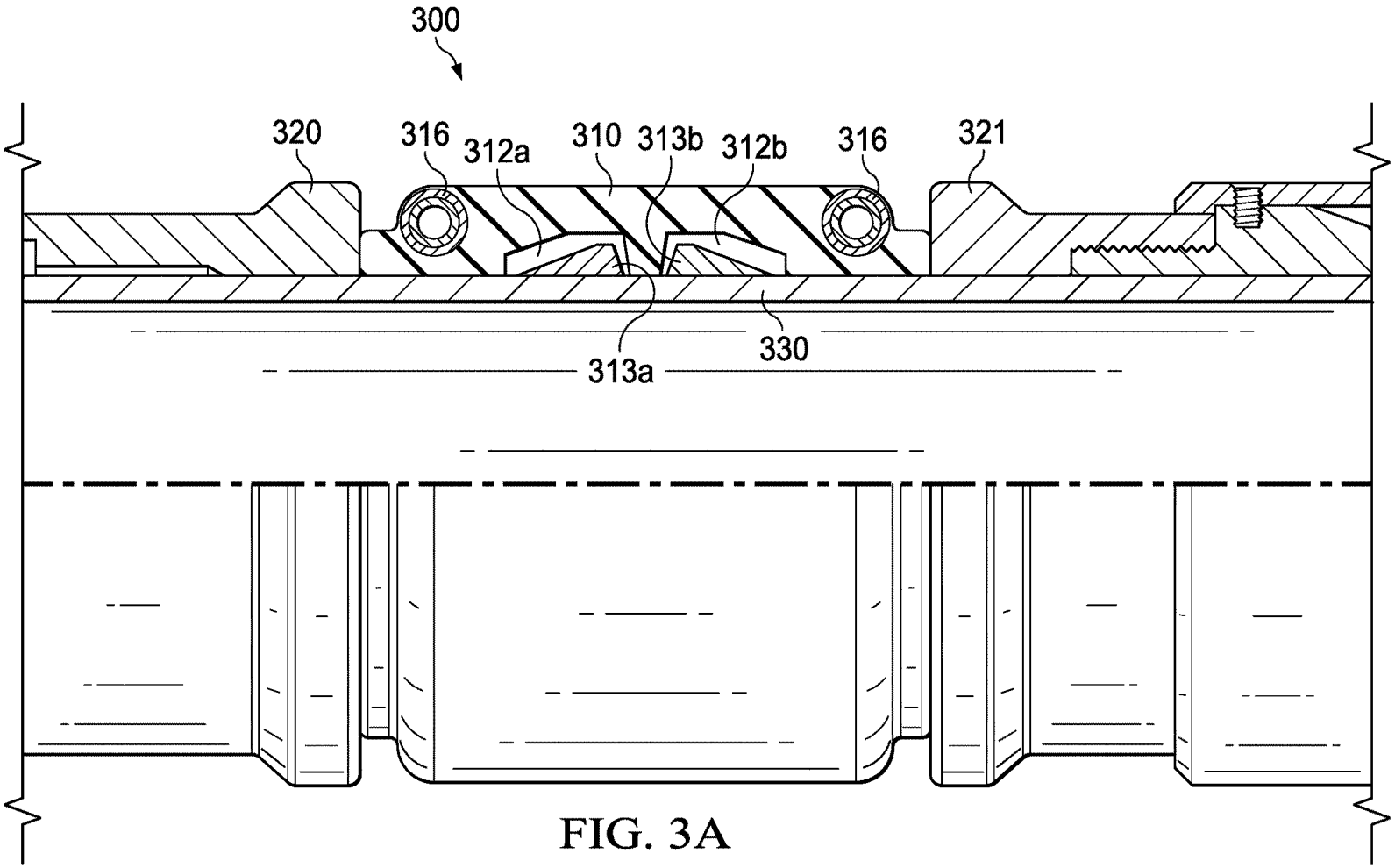
FIG. 3A illustrates a cross-sectional schematic view of a packing element that includes a sealing element with cavities in a run position according to an illustrative embodiment.
Figure 3B:
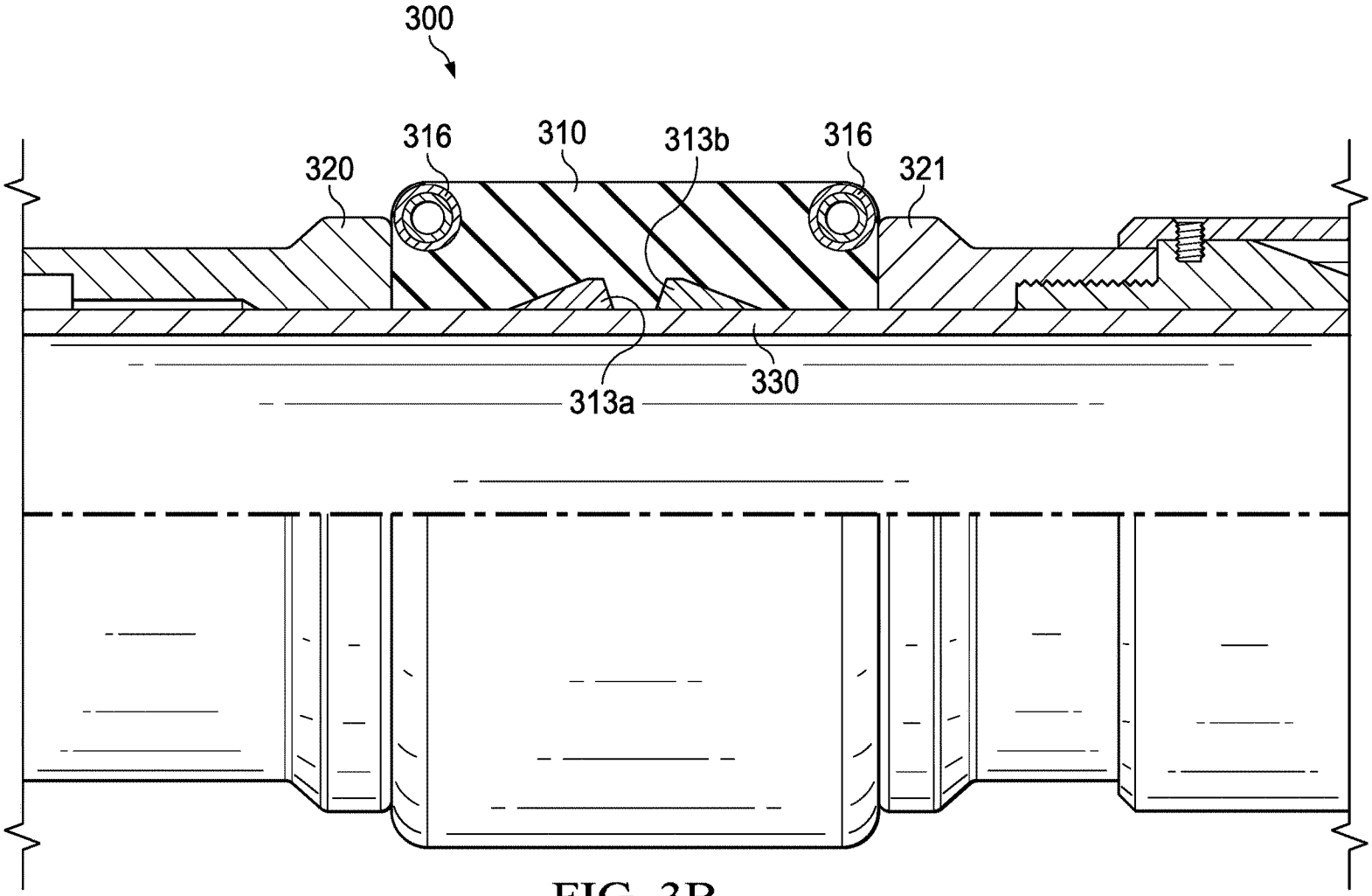
FIG. 3B illustrates a cross-sectional schematic view of the packing element of FIG. 3A in a set position according to an illustrative embodiment.

In some embodiments, a packing element 300 is provided that includes a sealing element 310 with cavities 312*a* and 312*b* as shown in FIGS. 3A and 3B. Particularly, FIG. 3A illustrates a cross-sectional schematic view of a packing element 300 that includes a sealing element 310 in a run position according to an illustrative embodiment. FIG. 3B illustrates a cross-sectional schematic view of the packing element 300 that includes the sealing element 310 in a set position according to an illustrative embodiment. The packing element 300, as shown in FIGS. 3A and 3B, also includes a first gauge ring 320 positioned at a first end of the sealing element 310. The packing element 300 also includes a second gauge ring 321 positioned at a second end of the sealing element 310. The first end may also be called an upper end of the packing element 300 and the second end may also be called the lower end of the packing element 300. Further, the packing element 300 also includes a first wedge ring 313*a* and a second wedge ring 313*b* positioned between the sealing element 310 and the mandrel 330.

The sealing element 310 is may be manufactured from a variety of types of materials such as single and dual elastomeric materials, non-elastomeric composites, metallic materials, metallic matrix materials, and similar materials discussed herein. Further, the sealing element 310 includes cavities 312*a* and 312*b* that are provided on an inner surface, which may also be called a lower surface, of the sealing element 310. The lower surface of the sealing element 310 is adjacent and in contact with an outer surface of a mandrel 330. In some embodiments, the first cavity 312*a* and the second cavity 312*b* have different dimensions. In one of such embodiments, the first cavity 312*a* has a similar but smaller shape as compared to the second cavity 312*b*. Further, the first cavity 312*a* has a smaller depth value relative to the depths value of the second cavity 312*b*. In some embodiments, the difference in the depth value between the first cavity 312*a* and the second cavity 312*b* is approximately 10%. In other embodiments, the difference in the depth value may be any value up to as high as 25%. In a preferred embodiment the difference in the depth value between the first cavity 312*a* and the second cavity 312*b* is between 15% and 20%. In the run position the sealing element may also have thinner portions at either end of the sealing element 310. In further embodiments, the first cavity 312*a* and the second cavity 312*b* have similar cross-sectional shapes. In one of such embodiments, the volume of the first cavity 312*a* and the volume of the second cavity 312*b* are different.

In the embodiment illustrated in FIG. 3A, the sealing element 310 also has a set of garter springs 316. The garter springs 316 are integrated into an outer surface of the sealing element 310 proximate the first end and the second end of the sealing element 310, respectively. The garter springs 316 include an outer spring that is filled with a plurality of ball bearings disposed within the outer spring. Further, the first wedge ring 313*a* is placed such that it fits into the first cavity 312*a*. The second wedge ring 313*b* is placed such that it fits into the second cavity 312*b*.

In another embodiment, the garter springs 316 may include an outer spring and an inner spring disposed within the outer spring. In another embodiment, the garter springs 316 may be a hollow string or tubular. Ball bearings and/or an inner spring may be similarly placed inside the hollow string or tubular. In situations where the sealed pressure is very high, for example above 5,000 psi, the garter springs 316 that may be manufactured from a metal are used on either side of the sealing element 310 to prevent the seal element 310 from extruding.

In an embodiment, when the packing element 300 is provided with a compressive force, one or both of the gauge rings 320, 321 will slide toward each other causing the sealing element 310 to compress and deform along an axis A-A. The first and second gauge rings 320 and 321 may have non-beveled contact surfaces that interact with the sealing element 310 to compress the sealing element 310. The non-beveled contract surfaces of the first and second gauge rings 320 and 321 inhibit and/or prevent an axial reactionary force from the sealing element 310. Further, the non-beveled contract surfaces also provide additional resistance to any axial loads (not shown) of the mandrel 330 proximate to the packing element 300. This compression and deformation leads to the sealing element 310 expanding vertically away from the mandrel 330 and away from axis A-A toward a wellbore surface and/or tubing/casing. This vertical expanding of the sealing element 310 is guided by the wedge rings 313*a* and 313*b* that are in the cavities 312*a* and 312*b* along which the sealing element 310 slides and deforms vertically. Further, the first and second wedge rings 313*a* and 313*b* reduce the amount of setting force needed to deploy the setting element 310. The first and second wedge rings 313*a* and 313*b* may each have a rear steep flank and a front shallow flank. The first and second wedge rings 312*a* and 313*b* may also be formed into another shape that fits into the first and second cavities 312*a* and 312*b*, respectively. In one embodiment, the thicker of the first and second wedge rings 313*a* and 313*b* is positioned further away from a direct setting force so that a smaller amount of setting force may cause setting element 310 proximate to the setting force to expand relative to setting element 310 further away from the setting force. As such, the sealing element 310 initially expands asymmetrically because of the differently shaped cavities 312*a* and 312*b* and wedge rings 313*a* and 313*b* within the cavities 312*a* and 312*b*, respectively.

The asymmetrical expansion allows a select portion of the sealing element 310 to come in contact with the wellbore or tubing before the remaining portions of the sealing element 310 come in contact with the wellbore, thereby providing for a more symmetrical final set position. When the setting process nears and reaches completion, the sealing element 310 is symmetrically shaped and set in the set position. Further, in the set position as shown in FIG. 3B, the garter springs 316 are similarly positioned at the upper first and upper second corners of the sealing element 310. Additionally, in the set position as shown in FIG. 3B, the thinner portions are deformed into the sealing element 310, thereby providing additional upward expansion, added support, and sealing strength at both the first and second ends of the sealing element 310. In some embodiments, the overall shape of the upper surface of the sealing element 310 is approximately symmetrical and consistent in the set position. Similarly, overall shape of surfaces of the sealing element 310 proximate the first and second ends of the sealing element 310 are also approximately symmetrical and consistent in the set position. The lower surface of the sealing element 310 that is adjacent to the mandrel 330 may have some asymmetric properties due, in part, to the differently shaped cavities 312*a* and 312*b* and the wedge rings 313*a* and 313*b*.

Figure 4:
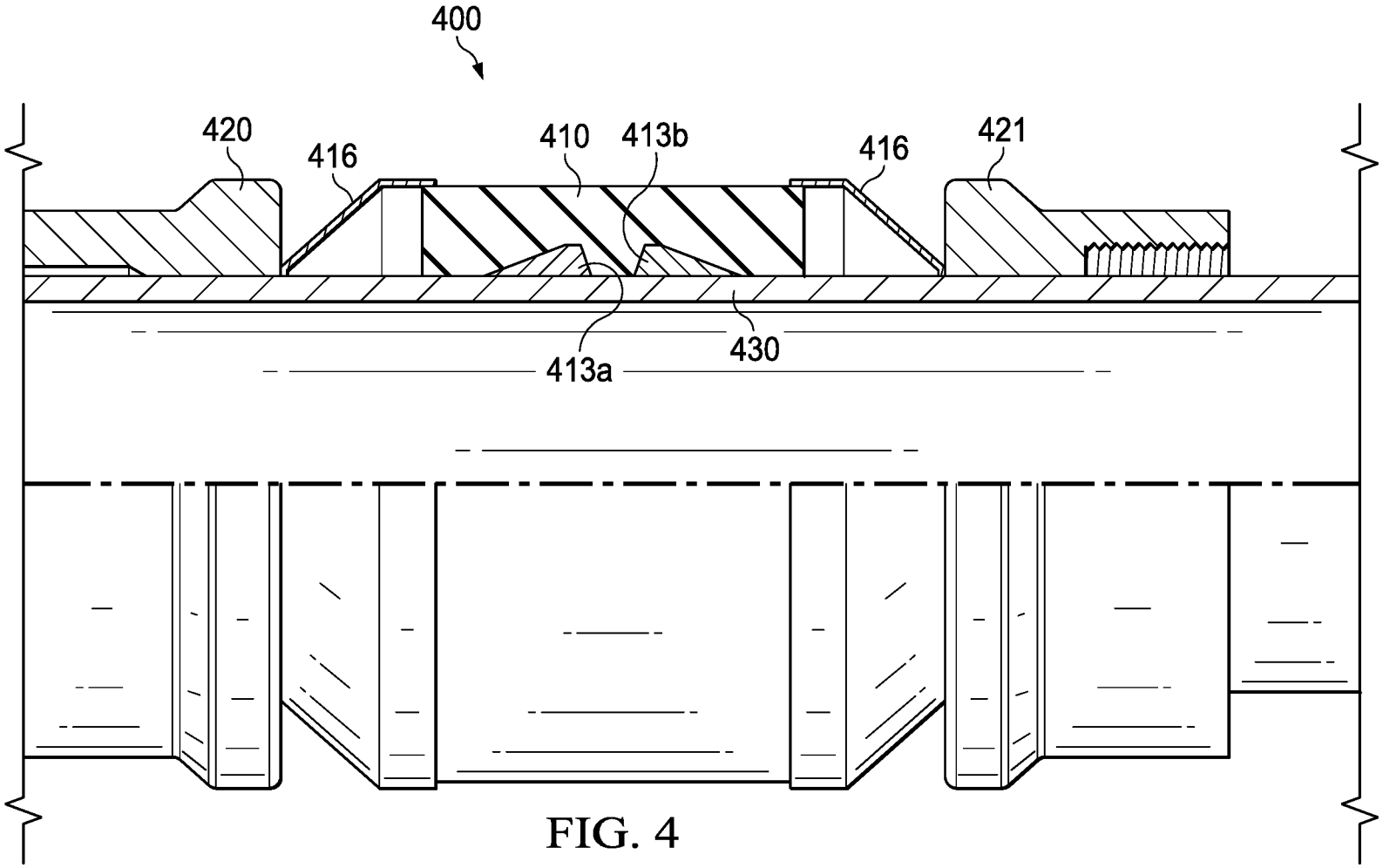
FIG. 4 illustrates a cross-sectional schematic view of a packing element that includes a sealing element with anti-extrusion rings according to an illustrative embodiment.

FIG. 4 illustrates a cross-sectional schematic view of a packing element 400 that includes a sealing element 410 with anti-extrusion rings 416 according to an illustrative embodiment. The packing element 400, similar to the packing element 300 of FIG. 3A includes a first gauge ring 420, a second gauge ring 421, a first wedge ring 413*a*, and a second wedge ring 413*b*. The functions of the first gauge ring 420, a second gauge ring 421, a first wedge ring 413*a*, and a second wedge ring 413*b*, are similar and/or identical to the functions of the first gauge ring 320, the second gauge ring 321, the first wedge ring 313*a*, and the second wedge ring 313*b* illustrated in FIGS. 3A and 3B, and as discussed herein. Further, the packing element 400 also includes anti-extrusion rings 416, which are integrated into an outer surface of the sealing element 410 proximate the first end and the second end of the sealing element 410, respectively. The anti-extrusion rings 416, similar to the garter rings 316, reduce and/or eliminate gap extrusions that may be formed when a setting force is applied to set the sealing element 410. Although garter springs 316 and anti-extrusion rings 416 are deployed in the embodiment of FIGS. 3A, 3B, and 4 to prevent undesired extrusion of the seal element 310 and 410, the garter springs 316 and anti-extrusion rings 416 may be replaced with another type of anti-extrusion element.

Figure 5A:
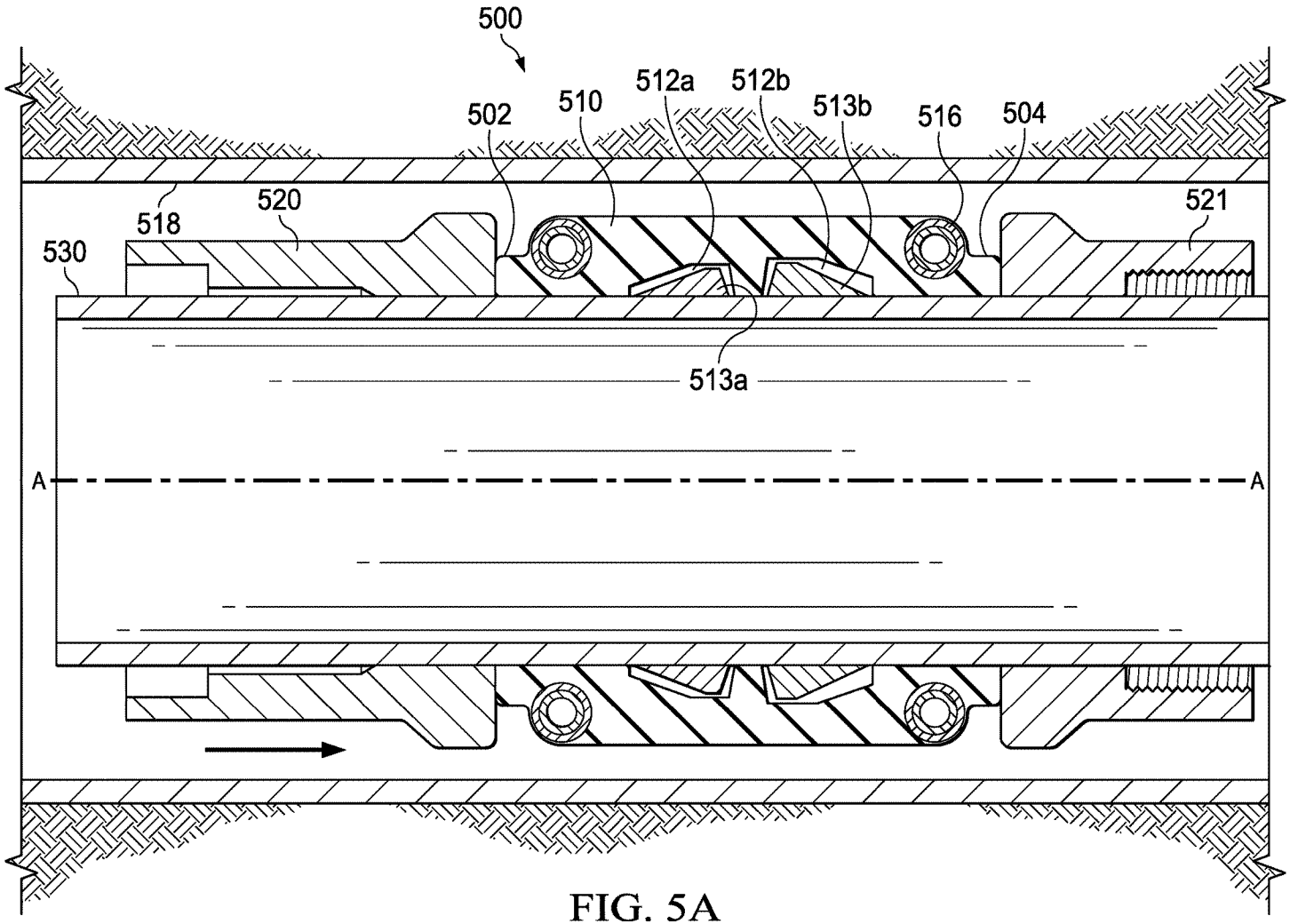
FIG. 5A illustrates a cross-sectional schematic view of a packing element that includes a sealing element with cavities in a run position according to an illustrative embodiment.
Figure 5B:
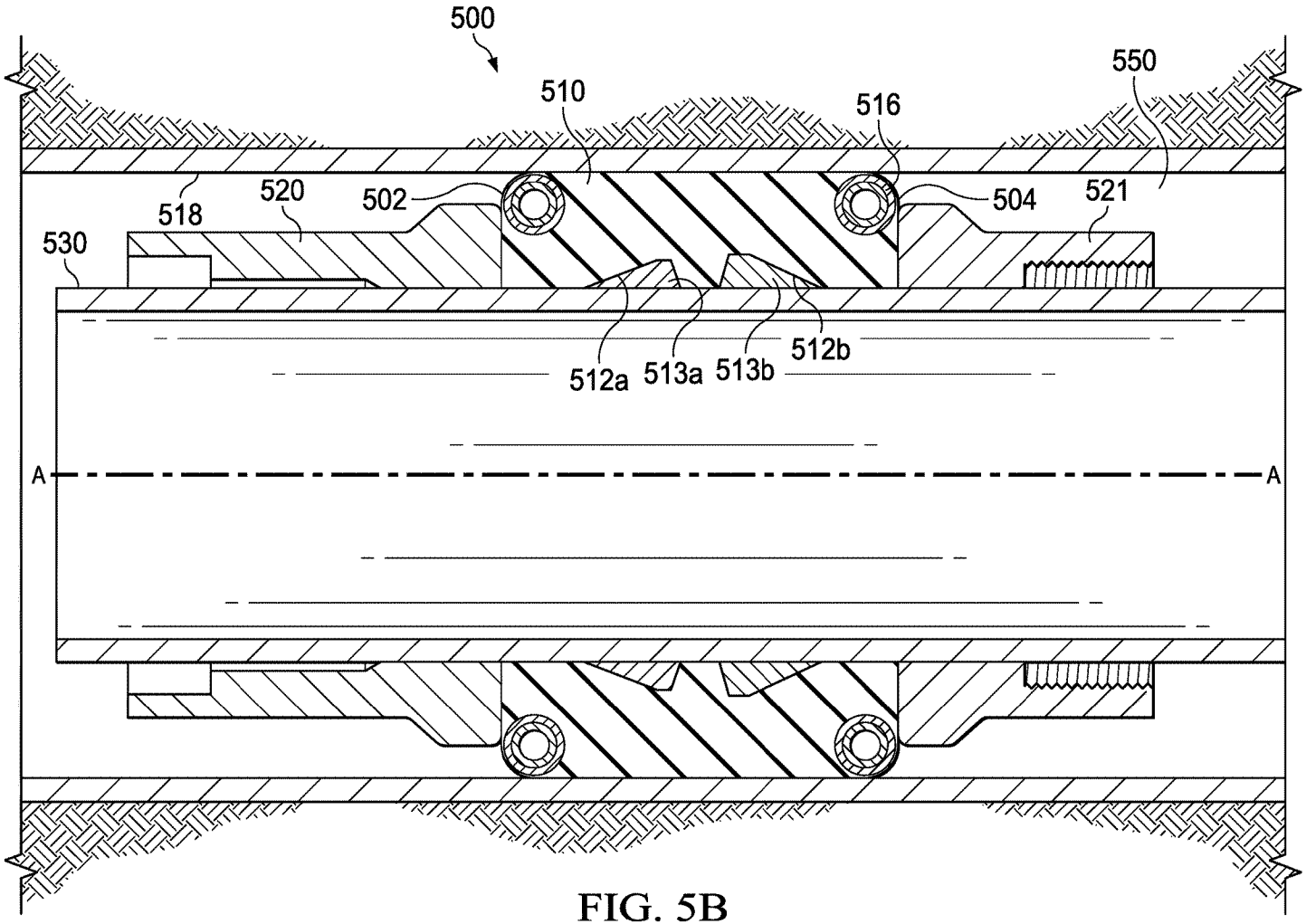
FIG. 5B illustrates a cross-sectional schematic view of the packing element of FIG. 5A in a set position created by a compressive force provided at a second end of the packing element according to an illustrative embodiment.

FIG. 5A illustrates a cross-sectional schematic view of a packing element 500 that includes a sealing element 510 having garter rings 516 and cavities 512*a* and 512*b* in a run position according to an illustrative embodiment. The sealing element 510 includes a first cavity 512*a* positioned proximate a first end 502 of the sealing element 510, and a second cavity 512*b* positioned proximate a second end 504 of the sealing element 510. The first cavity 512*a* has smaller dimensions relative to the second cavity 512*b* and is more proximate to the first end 502, from which the compressive force is applied. In some embodiments, the compressive force originates from a uni-directional force that is applied along a longitudinal axis of the packing element 500. In one of such embodiments, the uni-directional force is applied by a setting tool or another tool operable to generate a force along the longitudinal axis of the packing element 500. The packing element 500 also includes a mandrel 530 with an outer surface along which a first gauge ring 520, a second gauge ring 521, a first wedge ring 513*a*, a second wedge ring 513*b*, and the sealing element 510 are provided. FIG. 5B illustrates a cross-sectional schematic view of the packing element 500 of FIG. 5A in a set position created by a compressive force provided from the first end 502 of the packing element 500 according to an illustrative embodiment. When positioned in the set position, the packing element 500 defines an annulus 550 between the mandrel 530 and wellbore surface 518.

Figure 6A:
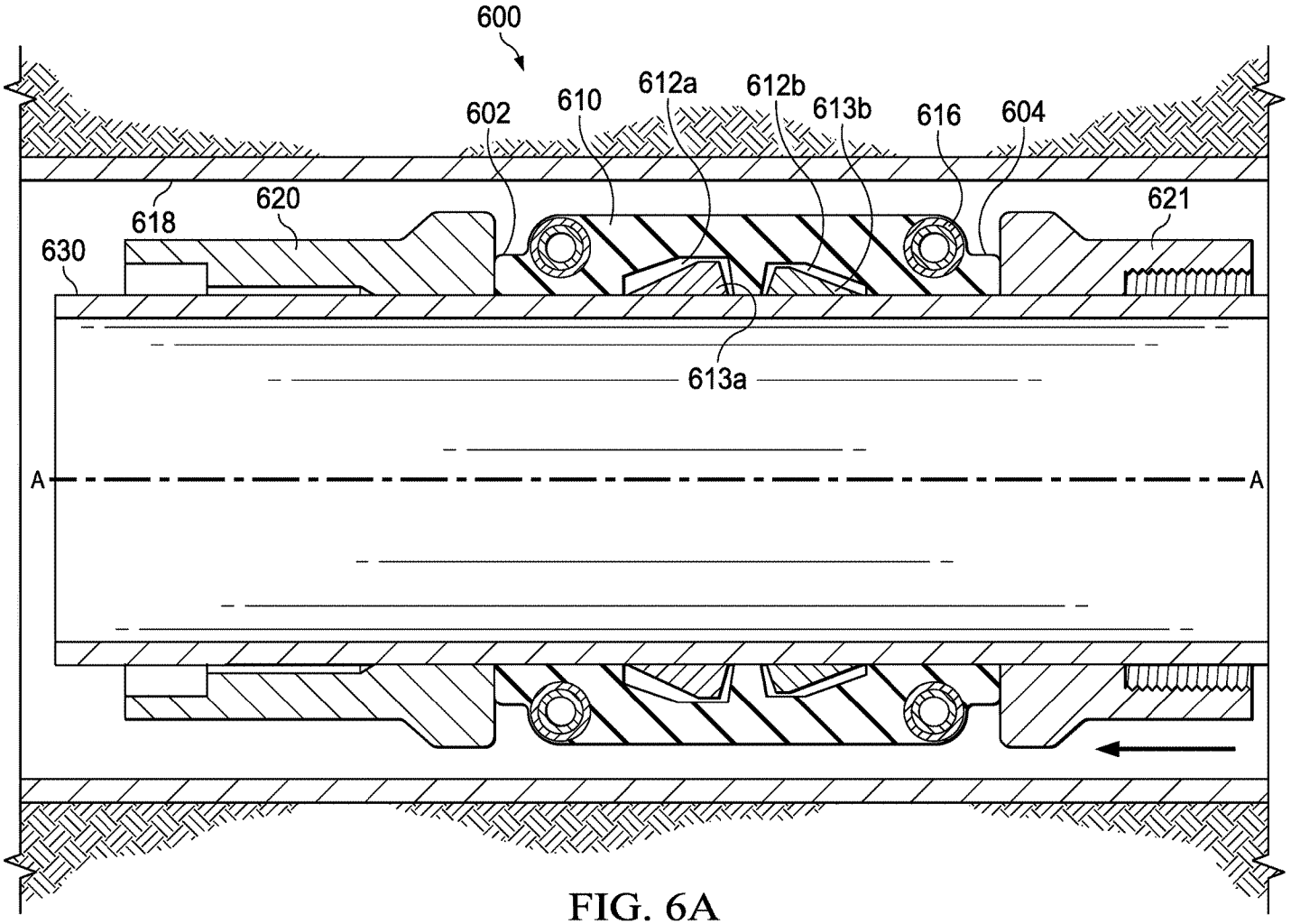
FIG. 6A illustrates a cross-sectional schematic view of a packing element in a run position that includes a sealing element with cavities according to an illustrative embodiment.
Figure 6B:
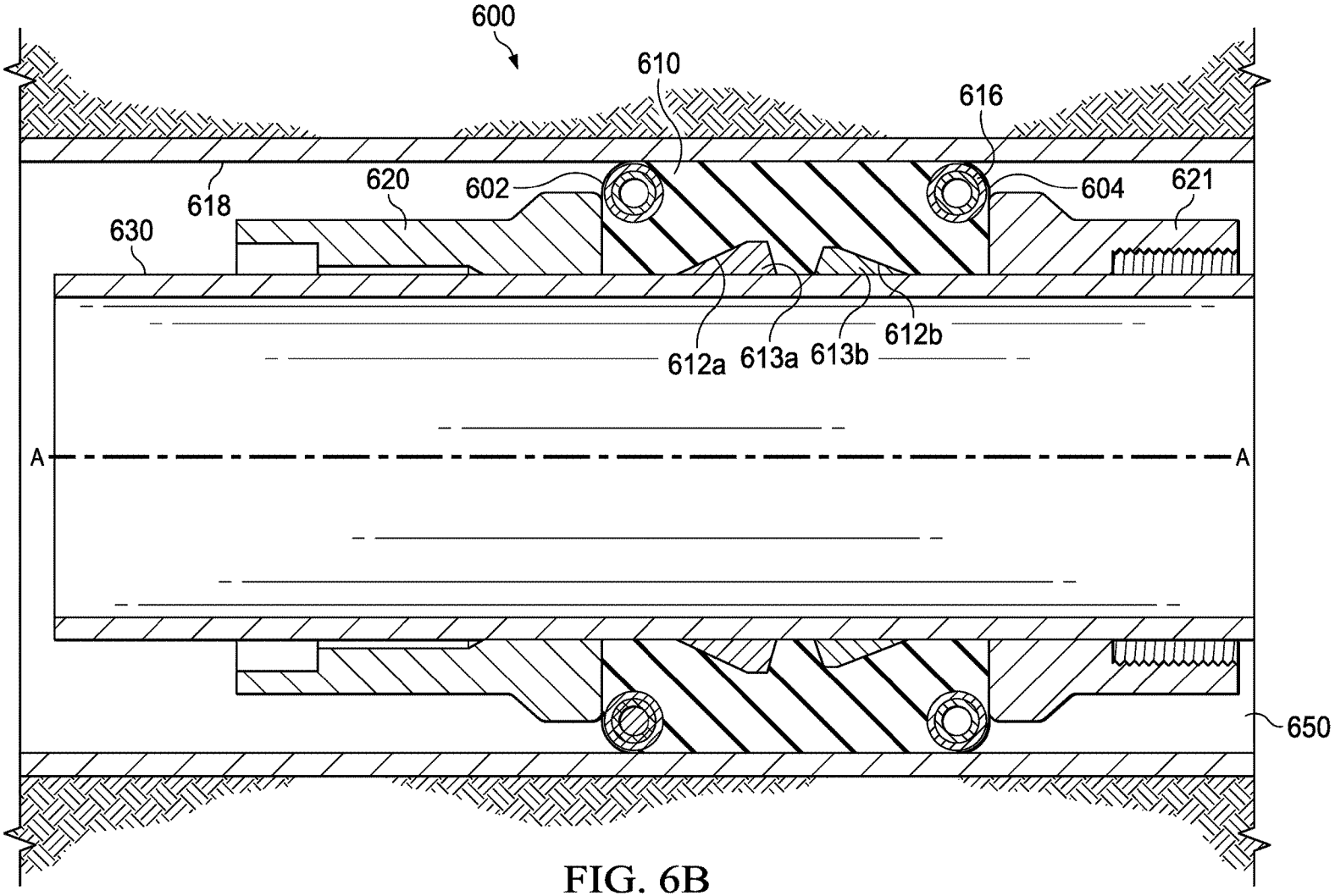
FIG. 6B illustrates a cross-sectional schematic view of the packing element of FIG. 6A in a set position created by a compressive force provided at a first end of the packing element according to an illustrative embodiment.

FIG. 6A illustrates a cross-sectional schematic view of a packing element 600 that includes a sealing element 610 with garter rings 616 and cavities 612*a* and 612*b* in a run position according to an illustrative embodiment. The sealing element 610 includes a first cavity 612*a* positioned proximate a first end 602 of the sealing element 610, and a second cavity 612*b* positioned proximate a second end 604 of the sealing element 610. The second cavity 612*b* has smaller dimensions relative to the first cavity 612*a*, and is more proximate to the second end 504, from which the compressive force is applied. In another embodiment, the compressive force is applied to the first end 602 of the sealing element 610, which is proximate the larger first cavity 612*a* to symmetrically set the packing element 600. In some embodiments, the compressive force originates from a uni-directional force that is applied along a longitudinal axis of the packing element 600. In one of such embodiments, the uni-directional force is applied by a setting tool or another tool operable to generate a force along the longitudinal axis of the packing element 600. Although the uni-directional forces illustrated in FIGS. 5A and 6A appear to originate from opposite directions along the longitudinal axis of the packing element 500 and 600, respectively, in some embodiments, a single uni-directional force along either direction is sufficient to set the packing element 500 and 600. The packing element 600 also includes a mandrel 630 with an outer surface along which a first gauge ring 620, a second gauge ring 621, a first wedge ring 613*a*, a second wedge ring 613*b*, and the sealing element 610 are provided. FIG. 6B illustrates a cross-sectional schematic view of the packing element 600 of FIG. 6A in a set position created by a compressive force provided from the second end 604 of the packing element 600 according to an illustrative embodiment. As shown, the sealing element 600 is set in a symmetrical position that includes the placement of a set of garter rings 616 at each the upper proximal and distal corners of the sealing element 610. When positioned in the set position, the packing element 600 defines an annulus 650 between the mandrel 630 and wellbore surface 618.

While a portion of a wellbore may in some instances be formed in a substantially vertical orientation, or relatively perpendicular to a surface of the well, the wellbore may in some instances be formed in a substantially horizontal orientation, or relatively parallel to the surface of the well, the wellbore may include portions that are partially vertical (or angled relative to substantially vertical) or partially horizontal (or angled relative to substantially horizontal). In some wellbores, a portion of the wellbore may extend in a downward direction away from the surface and then back up toward the surface in an "uphill," such as in a fish hook well. The orientation of the wellbore may be at any angle leading to and through the reservoir.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a packing element for use in a wellbore comprising: a sealing element positioned on an outer surface of a mandrel deployed in the wellbore, wherein the sealing element is disposed in an annulus between the mandrel and a portion of the wellbore, and wherein the sealing element comprises: a first cavity on an inner surface of the sealing element, the first cavity having a first size, wherein the first cavity is positioned approximate a first end of the sealing element; and a second cavity on the inner surface of the sealing element, the second cavity having a second size that is different from the first size, wherein the second cavity is positioned approximate a second end of the sealing element; a first gauge ring positioned proximate the first end of the sealing element; and a second gauge ring portioned proximate the second end of the sealing element.

Clause 2, the packing element of clause 1, wherein the first gauge ring comprises a substantially non-beveled contact surface that is positioned approximately perpendicular to the mandrel and is operable to apply a compressive force to the first end of the sealing element, and wherein the second gauge ring comprises a substantially non-beveled contact surface that is approximately perpendicular to the mandrel and is operable to apply a compressive force to the second end of the sealing element.

Clause 3, the packing element of clause 1 or 2, wherein the compressive force to the first end of the sealing element originates from a uni-directional force applied by a setting tool along a longitudinal axis of the packing element, and wherein the packing element is set in position in response to the uni-directional force applied by the setting tool.

Clause 4, the packing element of clause 1 or 2, wherein the compressive force to the second end of the sealing element originates from a uni-directional force applied by a setting tool along a longitudinal axis of the packing element, and wherein the packing element is set in position in response to the uni-directional force applied by the setting tool.

Clause 5, the packing element of any of the clauses 1-4, wherein the sealing element further comprises: a first garter spring integrated into an outer surface of the sealing element, wherein the first garter spring is disposed proximate the first end of the sealing element; and a second garter spring integrated into the outer surface of the sealing element, wherein the second garter spring is disposed proximate the second end of the sealing element.

Clause 6, the packing element of any of clauses 1-5, wherein the first garter spring comprises a first outer spring and a first plurality of ball bearings disposed within the first outer spring, and wherein the second garter spring comprises a second outer spring and a second plurality of ball bearings disposed within the second outer spring.

Clause 7, the packing element of any of clauses 1-5, wherein the first garter spring comprises a first outer spring and a first inner spring disposed within the first outer spring, and wherein the second garter spring comprises a second outer spring and a second inner spring disposed within the second outer spring.

Clause 8, the packing element of any of clauses 1-7, wherein the sealing element further comprises: a first anti-extrusion ring integrated into an outer surface of the sealing element, wherein the first anti-extrusion ring is disposed proximate the first end of the sealing element; and a second anti-extrusion ring integrated into the outer surface of the sealing element, wherein the second anti-extrusion ring is disposed proximate the second end of the sealing element.

Clause 9, the packing element of any of clauses 1-8, further comprising: a first wedge ring positioned between the sealing element and the mandrel, wherein the first wedge ring is disposed within the first cavity; and a second wedge ring positioned between the sealing element and the mandrel, wherein the second wedge ring is disposed within the second cavity.

Clause 10, the packing element of any of clauses 1-9, wherein a first depth of the first cavity is 10%-25% larger than a second depth of the second cavity.

Clause 11, the packing element of clauses 1-9, wherein a first depth of the first cavity is 10%-25% smaller than a second depth of the second cavity.

Clause 12, the packing element of any of clauses 1-11, wherein the first cavity has a first cross-sectional shape and a first volume, and wherein the second cavity has a second cross-sectional shape and a second volume, the first cross-sectional shape and the second cross sectional shape being similar, and wherein the first volume and the second volume are different.

Clause 13, a packing element for use in a wellbore comprising: a sealing element positioned on an outer surface of a mandrel in an annulus between the mandrel and a portion of the wellbore, wherein the sealing element comprises a plurality of cavities having different depths and volume; and a set of gauge rings positioned at a first end and a second end of the sealing element.

Clause 14, the packing element of clause 13, further comprising: a first garter spring integrated into an outer surface of the sealing element, wherein the first garter spring is disposed proximate the first end of the sealing element; and a second garter spring integrated into the outer surface of the sealing element, wherein the second garter spring is disposed proximate the second end of the sealing element.

Clause 15, the packing element of clause 13 or 14, further comprising a plurality of wedge rings positioned between the sealing element and the mandrel, wherein the plurality of wedge rings are disposed within the plurality cavities.

Clause 16, the packing element of any of clauses 13-15, wherein the sealing element is manufactured from at least one of a single elastomeric material, an elastomer compound, an non-elastomeric composite, a metallic material, and a metallic matrix material.

Clause 17, a sealing element of a packing element for use in a wellbore, the sealing element comprising: a body manufactured from an elastomer; a first cavity on an inner surface of the body, the first cavity having a first size, wherein the first cavity is positioned proximate a first end of the body; and a second cavity on the inner surface of the body, the second cavity having a second size that is different from the first size, wherein the second cavity is positioned proximate a second end of the body.

Clause 18, the sealing element of clause 17, further comprising: a first garter spring integrated into an outer surface of the sealing element, wherein the first garter spring is disposed proximate the first end of the sealing element; and a second garter spring integrated into the outer surface of the sealing element, wherein the second garter spring is disposed proximate the second end of the sealing element.

Clause 19, the sealing element of any of clauses 17 and 18, wherein the first garter spring comprises a first outer spring and a first plurality of ball bearings disposed within the first outer spring, and wherein the second garter spring comprises a second outer spring and a second plurality of ball bearings disposed within the second outer spring.

Clause 20, the sealing element of any of clauses 17 and 18, wherein the first garter spring comprises a first outer spring and a first inner spring disposed within the first outer spring, and wherein the second garter spring comprises a second outer spring and a second inner spring disposed within the second outer spring.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof.

We claim:

1. A packing element for use in a wellbore comprising:

sealing element positioned on an outer surface of a mandrel deployed in the wellbore, wherein the sealing element is disposed in an annulus between the mandrel and a portion of the wellbore, and wherein the sealing element comprises:

a first cavity on an inner surface of the sealing element, the first cavity having a first size, wherein the first cavity is positioned approximate a first end of the sealing element;

a first wedge ring positioned between the first cavity and the mandrel;

a second cavity on the inner surface of the sealing element, the second cavity having a second size that is different from the first size, wherein the second cavity is positioned approximate a second end of the sealing element;

a second wedge ring positioned between the second cavity and the mandrel;

a first gauge ring positioned proximate the first end of the sealing element; and a second gauge ring portioned proximate the second end of the sealing element.

2. The packing element of claim 1, wherein the first gauge ring comprises a substantially non-beveled contact surface that is positioned approximately perpendicular to the mandrel and is operable to apply a compressive force to the first end of the sealing element, and wherein the second gauge ring comprises a substantially non-beveled contact surface that is approximately perpendicular to the mandrel and is operable to apply a compressive force to the second end of the sealing element.

3. The packing element of claim 2, wherein the compressive force to the first end of the sealing element originates from a uni-directional force applied by a setting tool along a longitudinal axis of the packing element, and wherein the packing element is set in position in response to the uni-directional force applied by the setting tool.

4. The packing element of claim 2, wherein the compressive force to the second end of the sealing element originates from a uni-directional force applied by a setting tool along a longitudinal axis of the packing element, and wherein the packing element is set in position in response to the uni-directional force applied by the setting tool.

5. The packing element of claim 1, wherein the sealing element further comprises:

a first garter spring integrated into an outer surface of the sealing element, wherein the first garter spring is disposed proximate the first end of the sealing element; and a second garter spring integrated into the outer surface of the sealing element, wherein the second garter spring is disposed proximate the second end of the sealing element.

6. The packing element of claim 5, wherein the first garter spring comprises a first outer spring and a first plurality of ball bearings disposed within the first outer spring, and wherein the second garter spring comprises a second outer spring and a second plurality of ball bearings disposed within the second outer spring.

7. The packing element of claim 5, wherein the first garter spring comprises a first outer spring and a first inner spring disposed within the first outer spring, and wherein the second garter spring comprises a second outer spring and a second inner spring disposed within the second outer spring.

8. The packing element of claim 1, wherein the sealing element further comprises:

a first anti-extrusion ring integrated into an outer surface of the sealing element, wherein the first anti-extrusion ring is disposed proximate the first end of the sealing element; and a second anti-extrusion ring integrated into the outer surface of the sealing element, wherein the second anti-extrusion ring is disposed proximate the second end of the sealing element.

9. The packing element of claim 1, wherein a first depth of the first cavity is 10%-25% larger than a second depth of the second cavity.

10. The packing element of claim 1, wherein a first depth of the first cavity is 10%-25% smaller than a second depth of the second cavity.

11. The packing element of claim 1, wherein the first cavity has a first cross-sectional shape and a first volume, and wherein the second cavity has a second cross-sectional shape and a second volume, the first cross-sectional shape and the second cross sectional shape being similar, and wherein the first volume and the second volume are different.

* * * * *